US006904899B2

(12) United States Patent
Kato

(10) Patent No.: US 6,904,899 B2
(45) Date of Patent: Jun. 14, 2005

(54) AIR-FUEL RATIO CONTROLLER FOR INTERNAL-COMBUSTION ENGINE

(75) Inventor: Naoto Kato, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/953,184

(22) Filed: Sep. 30, 2004

(65) Prior Publication Data

US 2005/0072139 A1 Apr. 7, 2005

(30) Foreign Application Priority Data

Oct. 6, 2003 (JP) ..... 2003-346854

(51) Int. Cl.[7] ..... F02P 41/00
(52) U.S. Cl. ..... 123/674; 123/672; 123/344
(58) Field of Search ..... 123/344, 349, 123/350, 378, 672, 674, 704

(56) References Cited

U.S. PATENT DOCUMENTS 5,762,055 A * 6/1998 Yamashita et al. ..... 123/677

FOREIGN PATENT DOCUMENTS

JP A 8-291738 11/1996

* cited by examiner

*Primary Examiner*—Bibhu Mohanty
(74) *Attorney, Agent, or Firm*—Oliff & Berridge, PLC

(57) ABSTRACT

An output signal from a downstream-side exhaust gas sensor is fed back into a fuel injection rate so that the air-fuel ratio of the exhaust gases flowing out from a catalyst may match a reference value. In this sub-feedback control process, the integral value of the deviation between the output signal of the downstream-side exhaust gas sensor and a reference value is calculated, and the resulting integral-data signal is smoothed. A learning value for compensating for the permanent error included in an air-fuel ratio signal from an A/F sensor is learnt from the integral-data signal generated by the above smoothing operation.

8 Claims, 5 Drawing Sheets

AIR-FUEL RATIO CONTROLLER FOR INTERNAL-COMBUSTION ENGINE

BACKGROUND OF THE INVENTION

1. Field of the Invention

The present invention relates to air-fuel ratio controllers for internal-combustion engines, and more particularly to an air-fuel ratio controller for an internal-combustion engine that has respective exhaust gas sensors disposed on both the upstream and downstream sides of a catalyst and controls the supply rate of a fuel in accordance with the output signals sent from the exhaust gas sensors.

2. Background Art

The apparatuses have heretofore been known which have a wide-area air-fuel ratio sensor (A/F sensor) disposed on the upstream side of a catalyst in an exhaust gas passageway and a dioxide gas sensor ($O_2$ sensor) on the downstream side of the catalyst, and thus which control the air-fuel ratio in accordance with the output signals sent from the two exhaust gas sensors. The A/F sensor is an exhaust gas sensor exhibiting linear output characteristics with respect to an air-fuel ratio. The $O_2$ sensor is an exhaust gas sensor exhibiting the so-called Z-characteristics with respect to the air-fuel ratio, in which case the output of the sensor suddenly changes between rich and lean sides with a theoretical air-fuel ratio as its reference. In a conventional controller having these two exhaust gas sensors, the amount of fuel injection is feedback-controlled in accordance with the output signal (air-fuel ratio signal) from the A/F sensor to ensure that the air-fuel ratio of the exhaust gases flowing into the catalyst equals a target air-fuel ratio (hereinafter, the control is referred to as the main feedback control). Along with the main feedback control, control is conducted by feeding the output signal from the $O_2$ sensor back into the amount of fuel injection (hereinafter, the control is referred to as sub-feedback control).

Sub-feedback control is executed to complement the main feedback control and improve the emission characteristics of the internal-combustion engine. The target air-fuel ratio for use in the main feedback control is set to an air-fuel ratio at which the catalyst can purify the exhaust gases with the highest achievable efficiently, and for the main feedback control, a feedback correction value is calculated according to the particular deviation between the air-fuel ratio signal from the A/F sensor and the target air-fuel ratio. The effects of various parameter changes in the internal-combustion engine, however, may cause the actual air-fuel ratio of the exhaust gases with respect to the target air-fuel ratio to tend to be biased to the rich side or the lean side, despite the main feedback control being conducted. If such a tendency continues, the will be exhausted of occluded oxygen before too long, and hydrocarbon (HC) and carbon monoxide (CO) will become unable to be purified (if the actual air-fuel ratio tends to be biased to the rich side). Conversely, the oxygen-occluding state of the catalyst will saturate and nitrogen oxides (NOx) will become unable to be purified (if the actual air-fuel ratio tends to be biased to the lean side).

The output signal from the $O_2$ sensor represents the oxygen-occluding state of the catalyst, and if the catalyst is exhausted of the occluded oxygen, the output signal from the $O_2$ sensor will be a rich-state output, whereas, if the oxygen-occluding state of the catalyst saturates, the output signal from the $O_2$ sensor will be a lean-state output. When the output signal from the $O_2$ sensor reverses to indicate a rich state, therefore, it can be judged that the actual air-fuel ratio of the exhaust gases flowing into the catalyst is biased to the rich side. Conversely, when the output signal from the $O_2$ sensor reverses to indicate a lean state, it can be judged that the actual air-fuel ratio is biased to the lean side.

For sub-feedback control, a sub-feedback correction value is calculated in accordance with the output signal from the $O_2$ sensor and then the sub-feedback correction value is fed back for the main feedback control, whereby the deviation between the air-fuel ratio signal from the A/F sensor and the target air-fuel ratio is corrected. Thus, the deviation between the air-fuel ratio signal from the A/F sensor and the target air-fuel ratio can be brought close to the deviation between an actual air-fuel ratio signal and a target air-fuel ratio, and thus, control accuracy of the air-fuel ratio by the main feedback control can be enhanced.

The conventional controllers known to control the air-fuel ratio by conducting sub-feedback control together with the main feedback control include, for example, the controller disclosed in Japanese Patent Laid-open No. 8-291738. During the sub-feedback control in this device, an air-fuel ratio correction value is calculated by conducting proportional and integral control (PI control) based on the output signal sent from the $O_2$ sensor and performing computations for a proportional term (P-term) and an integral term (I-term). Also, a weighted-averaging process is performed on this air-fuel ratio correction value and the result is calculated as an air-fuel ratio learning rate. After this, a target air-fuel ratio is corrected by adding thereto both the air-fuel ratio correction value and the air-fuel ratio learning rate to complement the main feedback control.

For the conventional controller disclosed in Japanese Patent Laid-open No. 8-291738, the air-fuel ratio learning rate is derived as a learning value from the air-fuel ratio correction value, and this air-fuel ratio correction value contains the P-term and I-term obtained by conducting PI control of the output signal sent from the 02 sensor. The I-term is a steady component indicating the steady-state deviation of the $O_2$ sensor output signal, whereas the P-term is a variable component that varies according to a particular change in the output signal of the $O_2$ sensor. For this reason, acquisition of the P-term to learning also causes a variable component to be included in the learning value.

Accordingly, the conventional controller has had the inconvenience in which the learning value during sub-feedback control significantly fluctuates or in which obtaining a stable learning value becomes a time-consuming operation. A significant fluctuation in the learning value or a decrease in the learning rate means that biasing of the air-fuel ratio of the exhaust gases toward the lean or rich side is allowed, thus making it impossible to maintain stable emission characteristics.

SUMMARY OF THE INVENTION

The present invention has been made in order to solve the above problems, and an object of the invention is to provide an air-fuel ratio controller for an internal-combustion engine that is constructed so that stable emission characteristics can be maintained by allowing stable acquisition of a learning value during sub-feedback control.

In accordance with one aspect of the present invention, the air-fuel ratio controller for an internal-combustion engine comprises an upstream-side exhaust gas sensor, a downstream-side exhaust gas sensor, main feedback means and sub-feedback means.

The upstream-side exhaust gas sensor is disposed upstream of a catalyst in an exhaust passageway of the internal-combustion engine. The downstream-side exhaust gas sensor is disposed downstream of the catalyst. The main feedback means feeds back an output signal received from the upstream-side exhaust gas sensor into a fuel injection rate so that an air-fuel ratio of the exhaust gases flowing out from the catalyst may match a target air-fuel ratio. The sub-feedback means feeds back the output signal received from the downstream-side exhaust gas sensor into the fuel injection rate so as to complement the feedback control conducted by the main feedback means.

The said sub-feedback means includes integral-data calculation means, smoothing means and learning means.

The integral-data calculation means calculates an integral value of a deviation between a value of the output signal of the downstream-side exhaust gas sensor and a reference value. the smoothing means smoothes the integral-data signal received from said integral-data calculation means. The learning means learns from the integral-data signal smoothed, a learning value which compensates for a permanent error included in the output signal of the upstream-side exhaust gas sensor.

Other objects and further features of the present invention will be apparent from the following detailed description when read in conjunction with the accompanying drawings.

DESCRIPTION OF THE PREFERRED EMBODIMENT

First Embodiment

A first embodiment of the present invention is described below referring to FIGS. 1 to 4.

Figure 1:
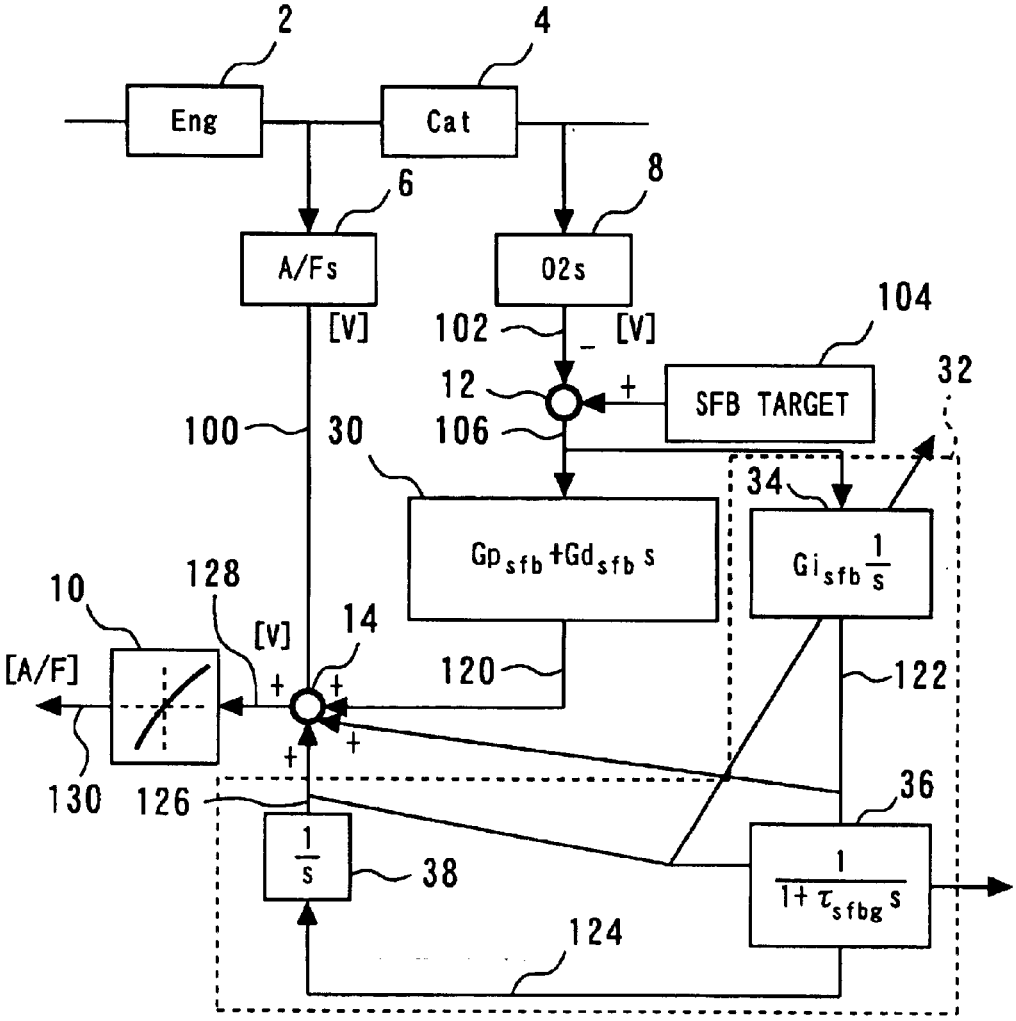
FIG. 1 is a block diagram showing the configuration of an air-fuel ratio controller according to a first embodiment of the present invention.
Figure 2:
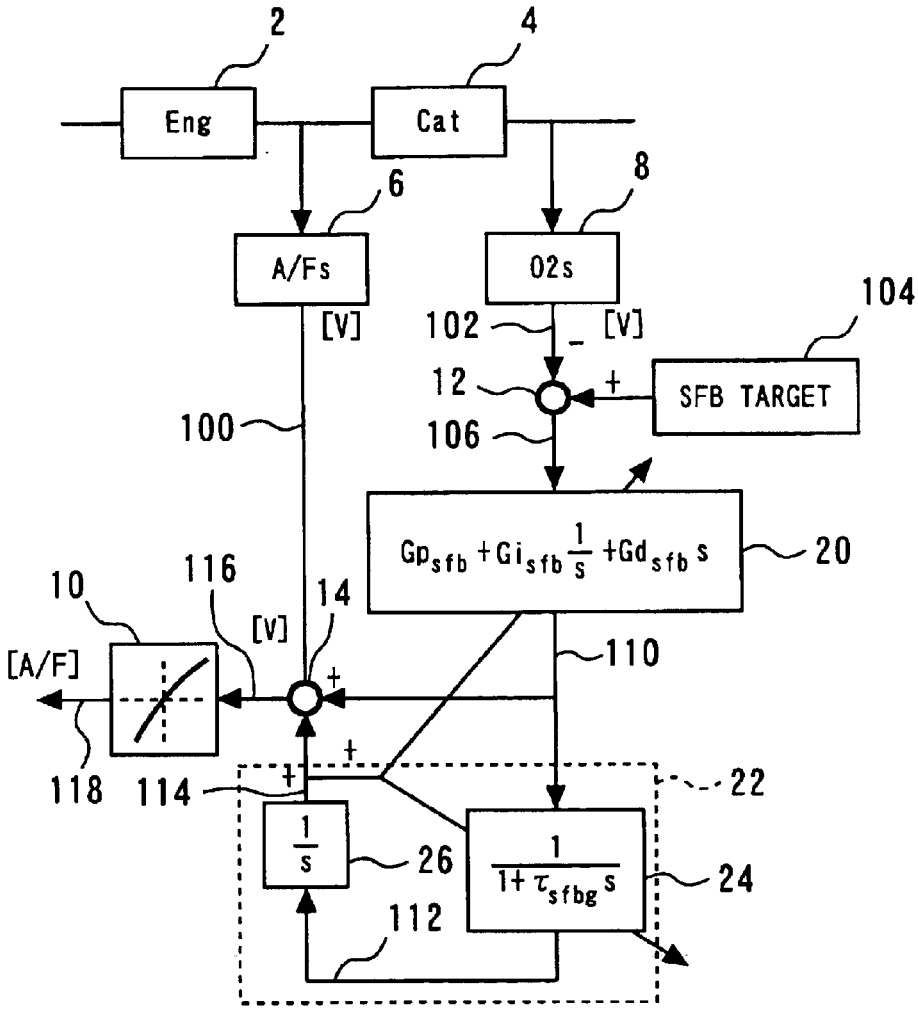
FIG. 2 is a block diagram showing the configuration of a comparison object device.

FIG. 1 is a block diagram showing the configuration of an air-fuel ratio controller according to the first embodiment of the present invention. FIG. 2 is a block diagram showing the configuration of an air-fuel ratio controller which was devised during drafting of the present invention (hereinafter, this air-fuel ratio controller is referred to as the comparison object device). Hereunder, these two air-fuel ratio controllers are contrasted to make features of the air-fuel ratio controller of the present embodiment clear and obvious. Although the air-fuel ratio controller of the present embodiment can conduct main feedback control and sub-feedback control, only sections related to the sub-feedback control are extracted and shown below. A method of conducting the main feedback control is not detailed below since the method does not form a major part of the present invention. The same reference numeral is assigned to those elements in both figures that are common thereto.

First, the configuration of the comparison object device is described. The conventional controller described in Japanese Patent Laid-open No. 8-291738 uses PI control to calculate an air-fuel ratio correction value and then correct a target air-fuel ratio. The comparison object device, however, uses PID control to calculate an air-fuel ratio correction value and then correct an A/F sensor air-fuel ratio signal according to the air-fuel ratio correction value.

As shown in FIG. 2, the comparison object device has an A/F sensor 6 disposed between an internal-combustion engine 2 and a catalyst 4, and an $O_2$ sensor 8 disposed downstream of the catalyst 4. An air-fuel ratio signal 100 that linearly responds to an air-fuel ratio of the exhaust gases flowing into the catalyst 4 is output from the A/F sensor 6. A signal 102 that indicates a lean or rich state of the air-fuel mixture included in the exhaust gases flowing out from the catalyst 4 is output from the $O_2$ sensor. The output signal 102 from the $O_2$ sensor 8 is compared with a sub-feedback (SFB) target value (reference value) 104 by a comparator 12. The SFB target value 104 is an output value equivalent to a theoretical air-fuel ratio. When the air-fuel mixture included in the exhaust gases flowing out from the catalyst 4 is rich, the output signal 102 from the $O_2$ sensor 8 indicates a value greater than the SFB target value 104. Conversely, when the above air-fuel mixture is lean, the output signal 102 indicates a value smaller than the SFB target value 104. The comparator 12 outputs an output deviation 106 which is an error between the SFB target value 104 and the output signal 102 from the $O_2$ sensor 8.

The output deviation 106 that has been output from the comparator 12 is input to a sub-PB controller 20. The sub-FB controller 20 conducts PID control in accordance with the output deviation 106 that has been input, and calculates a sub-FB correction value (air-fuel ratio correction value) 110. The operational expression shown with a frame in the sub-FB controller 20 of FIG. 2 indicates a transfer function for PID control. In the figure, "$Gp_{sfb}$" denotes a proportional gain of a proportional term (P-term), "$Gi_{sfb}$" denotes an integral gain of an integral term (I-term), and "$Gd_{sfb}$" denotes a derivative gain of a derivative term (D-term). The sub-FB correction value 110 that has been calculated during PID control is added to the air-fuel ratio signal 100 of the A/F sensor 6, in an adder 14. When the output signal 102 from the $O_2$ sensor 8 reverses to indicate a rich state, i.e., when the air-fuel ratio of the exhaust gases flowing into the catalyst 4 is biased to the rich side, the calculated sub-FB correction value 110 is updated to a negative value so that a level of an after-correction air-fuel ratio signal 116 is reduced for a rich state. Conversely, when the output signal 102 from the $O_2$ sensor 8 reverses to indicate a lean state, i.e., when the air-fuel ratio of the exhaust gases flowing into the catalyst 4 is biased to the lean side, the calculated sub-FB correction value 110 is updated to a positive value so that the level of the after-correction air-fuel ratio signal 116 is increased for a lean state.

Sub-feedback learning is also conducted for the comparison object device. Sub-feedback learning is the control where a displacement of a stoichiometric point (theoretical air-fuel ratio equivalent output) of the air-fuel ratio signal 100 from the A/F sensor 6 is obtained as a learning value 114. Here, a sub-FB learning unit 22 is equipped as sub-feedback learning means, and the sub-FB correction value 110 from the sub-FB controller 20 is input. In the sub-FB learning unit 22, an average value of the sub-FB correction value 110 is transferred to the learning value 114 in suitable timing.

More specifically, the sub-FB learning unit 22 includes a low-pass filter 24 and an SRAM (Static Random Access Memory) 26. The operational expression shown with a frame in the low-pass filter 24 of FIG. 2 represents a transfer function that indicates a configuration of the low-pass filter. In the figure, a primary delay element is used as the low-pass filter. After being input to the sub-FB learning unit 22, the sub-FB correction value 110 has its high-frequency components cut off by passing through the low-pass filter 24.

The sub-FB correction value 110 that has passed through the low-pass filter 24 is acquired into the SRAM 26 in required timing (for example, at a required fuel injection count). The operational expression shown with a frame in the SRAM 26 of FIG. 2 indicates the integral action intended to acquire a sub-FB correction value 112 into the SRAM 26. The learning value 114 is stored in the SRAM 26, and the air-fuel ratio correction value 112 newly acquired is integrated into the learning value 114 by the integral action. This means that each time a new sub-FB correction value 112 is acquired, the learning value 114 is updated to the value obtained by adding the particular sub-FB correction value 112. Since the sub-FB correction value 112 is integrated in this manner, the correction value for the permanent error included in the air-fuel ratio signal 100 is transferred from the sub-FB correction value 112 to the learning value 114. When the sub-FB correction value 112 is transferred from the low-pass filter 24 to the SRAM 26, a state quantity of the low-pass filter 24 is cleared and the I-term of the sub-FB controller 20 is corrected according to the particular state quantity of the low-pass filter 24.

The learning value 114, after being stored into the SRAM 26, is input to the adder 14, together with the air-fuel ratio correction value 110 that was calculated by the sub-FB controller 20, and then the learning value 114 is added to the air-fuel ratio signal 100 sent from the A/F sensor 6. Thus, the air-fuel ratio signal 100 from the A/F sensor 6 is corrected in a direction of offsetting a bias of an actual air-fuel ratio to the lean side or the rich side. The after-correction air-fuel ratio signal 116 that has thus been obtained is converted from a voltage value into the air-fuel ratio, in a conversion map 10, and the main feedback control is executed in accordance with an air-fuel ratio 118 which has been obtained by the conversion from the after-correction air-fuel ratio signal 116.

According to the comparison object device of the configuration described above, calculation of the sub-FB correction value (air-fuel ratio correction value) 110 by means of PID control allows the sub-FB correction value 110 to be converged more rapidly than in the conventional controller adapted to calculate the air-fuel ratio correction value by means of PI control. Also, since the sub-FB correction value 110 is converged rapidly, the learning value 114 derived from the sub-FB correction value 110 is considered to become more stable.

However., the sub-FB correction value 110 includes the P-term and D-term, which are variable components. For this reason, the learning value 114 where the P-term and the D-term are acquired during learning also includes variable components. The learning value 114 is therefore affected by a change in the output signal of the $O_2$ sensor 8. In addition, when the sub-FB correction value 112 is acquired into the SRAM 26, although the I-term of the sub-FB controller 20 is corrected according to the acquired sub-FB correction value 112 in order to establish matching, the correction also causes the I-term to be affected by a change in the output signal of the $O_2$ sensor 8, since the sub-FB correction value 112 includes a P-term and a D-term.

Therefore, the configuration described below has been adopted for the air-fuel ratio controller of the present embodiment in order to break through such inconvenient aspects of the comparison object device as mentioned above.

As shown in FIG. 1, the air-fuel ratio controller of the present embodiment is constructed as a double-sensor system which has an A/F sensor 6 serving as an upstream-side exhaust gas sensor disposed upstream of a catalyst 4, and an $O_2$ sensor 8 serving as a downstream-side exhaust gas sensor disposed downstream of the catalyst 4. During the main feedback control whose description is omitted, an air-fuel ratio signal 100 from the A/F sensor 6 is used to calculate a feedback correction value for correcting a fuel injection rate. During the sub-feedback control described below, an output signal 102 from the $O_2$ sensor 8 is used to calculate a sub-FB correction value (air-fuel ratio correction value) and a learning value.

The output signal 102 from the $O_2$ sensor 8 is first input to a comparator 12. In the comparator 12, the output signal 102 from the $O_2$ sensor 8 is compared with a sub-feedback (SFB) target value (reference value) 104 that is an output value equivalent to a theoretical air-fuel ratio, and an output deviation 106 between the SFB target value 104 and the output signal 102 from the $O_2$ sensor 8 is output. The output deviation 106 takes a negative value when an air-fuel ratio of the exhaust gases flowing out from the catalyst 4 indicates a rich state, and takes a positive value when the air-fuel ratio of the exhaust gases flowing out from the catalyst 4 indicates a lean state.

The air-fuel ratio controller of the present embodiment has a sub-FB controller 30 and a sub-FB learning unit 32. The output deviation 106 that has been output from the comparator 12 is concurrently input to the sub-FB controller 30 and the sub-FB learning unit 32. The sub-FB controller 30 is means for calculating a sub-FB correction value 120 responsive to a change in the output signal 102 of the $O_2$ sensor 8. Although PID control is conducted in the sub-FB controller 20 of the comparison object device, PD control is conducted in the sub-FB controller 30 of the present embodiment. The operational expression shown with a frame in the sub-FB controller 30 of FIG. 1 indicates a transfer function for PD control. In the figure, "$Gp_{sfb}$" denotes a proportional gain of a proportional term (P-term) and "$Gd_{sfb}$" denotes a derivative gain of a derivative term (D-term). The sub-FB correction value 120 that has been calculated by the sub-FB controller 30 during PD control is added to the air-fuel ratio signal 100 of the A/F sensor 6, in an adder 14. When the output signal 102 from the $O_2$ sensor 8 reverses to indicate a rich state, the sub-FB correction value 120 is updated to a negative value so that a level of an after-correction air-fuel ratio signal 128 may be reduced for a rich state. Conversely, when the output signal 102 from the $O_2$ sensor 8 reverses to indicate a lean state, the sub-FB correction value 120 is updated to a positive value so that the level of the after-correction air-fuel ratio signal 128 may be increased for a lean state.

The sub-FB learning unit 32 is means for learning, as a learning value 126, the permanent error included in the air-fuel ratio signal 100 of the A/F sensor 6, i.e., a displacement of a stoichiometric point of the air-fuel ratio signal 100. In the comparison object device, the learning value 114 is derived from the sub-FB correction value 110 that contains a P-term, an I-term, and a D-term, whereas, in the air-fuel ratio controller of the present embodiment, the learning value 126 is obtained only from the integral term (I-term) obtained by integral control (I-control) of the output deviation 106. The sub-FB learning unit 32 according to the present embodiment includes an integrator 34, a low-pass filter 36, and an SRAM 38. The I-control based on the output deviation 106 is conducted by the integrator 34 serving as an integral-data calculator in the present invention, and the deviation signal 106 from the comparator 12 is integrated by the integrator 34. The operational expression shown with a frame in the integrator 34 of FIG. 1 indicates a transfer function for I-control. In the figure, "$Gi_{fab}$" denotes an integral gain of an I-term. The integral-term signal (integral-data signal) 122 obtained by the integrator 34 during I-control indicates a steady-state deviation of the output signal 102 of the $O_2$ sensor 8 with respect to the SFB target value 104.

The integral-term signal 122 that has been obtained during I-control is concurrently input from the integrator 34 to the adder 14 and the low-pass filter 36. After being input to the low-pass filter 36, the integral-term signal 122 has its high-frequency components cut off and smoothed by the low-pass filter 36 functioning as smoothing means in the present invention. The operational expression shown with a frame in the low-pass filter 36 of FIG. 1 represents a transfer function that indicates a configuration of the low-pass filter. In the figure, a primary delay element is used as the low-pass filter, and "$\tau_{sfbg}$" denotes a response time constant of the low-pass filter. The transfer function shown in the figure is only an example of a low-pass filter, and a low-pass filter represented by other transfer functions may be used. Alternatively, a smoothing method other than low-pass filtering, such as weighted averaging, may be used, only if the method actually used allows signal smoothing by cutting off high-frequency components.

An integral-term signal (integral-data signal) 124 that is obtained as a result of smoothing through the low-pass filter 36 is acquired into the SRAM 38 in required timing (for example, at a required fuel injection count). The operational expression shown with a frame in the SRAM 38 of FIG. 1 represents the integral action for acquiring the integral-term signal 124 into the SRAM 38. The learning value 126 is stored in the SRAM 38, and each time a new integral-term signal 124 is acquired, the learning value 126 is derived and updated to the value obtained by integrating the integral-term signal 124. Thus, the correction value for the permanent error included in the air-fuel ratio signal 100 is transferred from the integral-term signal 124 to the learning value 126. When the integral-term signal 124 is transferred from the low-pass filter 36 to the SRAM 38, a state quantity of the low-pass filter 36 is cleared and a state quantity (I-term) of the integrator 34 is corrected according to the cleared state quantity of the low-pass filter 36.

The learning value 126, after being stored into the SRAM 38, is input to the adder 14, together with the above-mentioned sub-FB correction value 120 and the integral-term signal 124, and then added to the air-fuel ratio signal 100 sent from the A/F sensor 6. Thus, the air-fuel ratio signal 100 from the A/F sensor 6 is corrected in a direction of offsetting a bias of an actual air-fuel ratio to the lean side or the rich side. The after-correction air-fuel ratio signal 128 that has thus been obtained is converted from a voltage value into the air-fuel ratio, in a conversion map 10, and the main feedback control is executed in accordance with an air-fuel ratio 130 obtained by the conversion.

In the above-described configuration of the air-fuel ratio controller, the comparator 12, the adder 14, the sub-FB controller 30, the sub-learning unit 32, and the conversion map 10 are realized as functional components of the electronic control unit (ECU) that totally controls the internal-combustion engine. The ECU functions as the main feedback control means and sub-feedback control means according to the present invention, and the ECU, when functioning as the sub-feedback control means, receives the output signals supplied from the A/F sensor 6 and the $O_2$ sensor 8 and implements sub-feedback control in accordance with the routine shown in FIG. 3.

Figure 3:
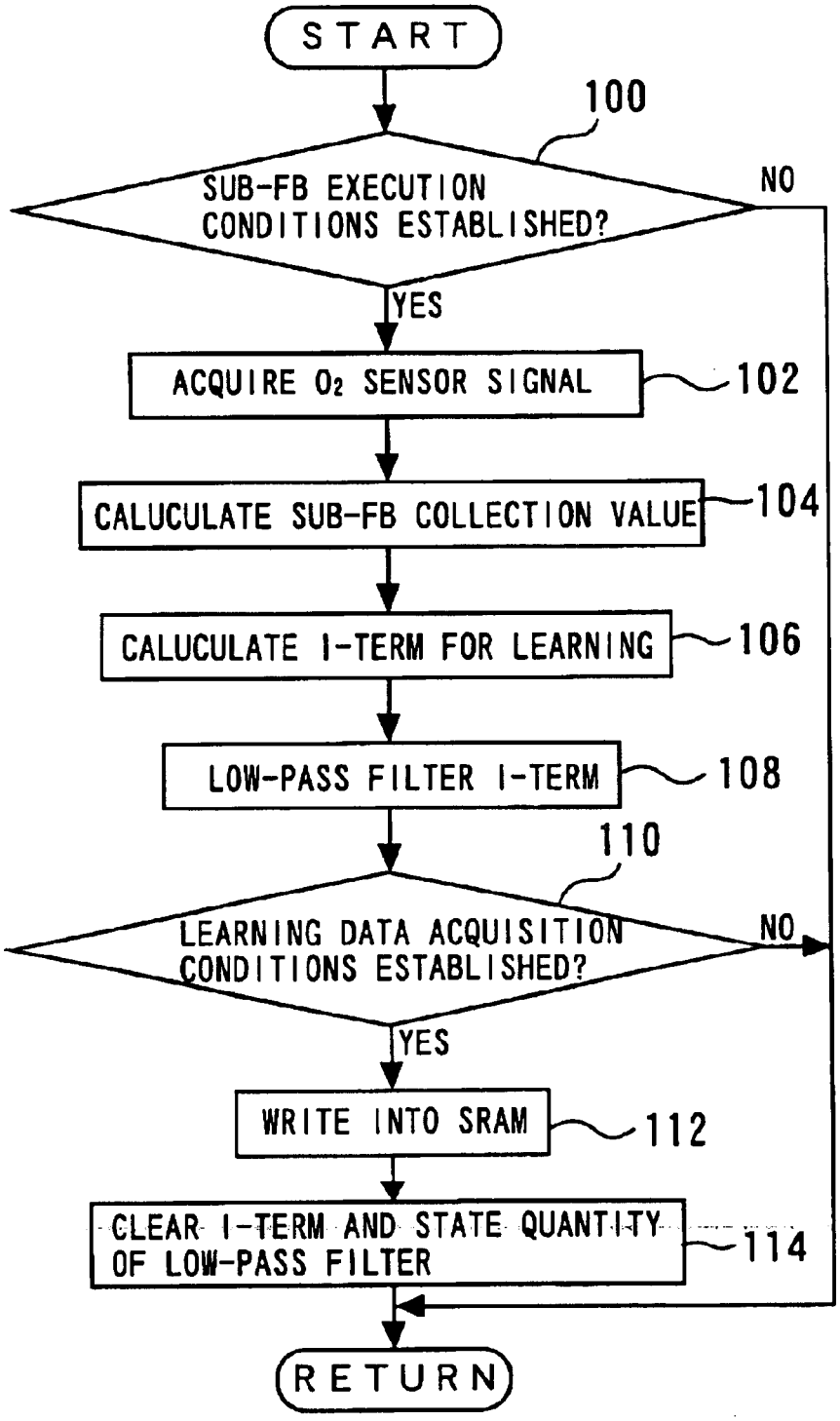
FIG. 3 is a flowchart illustrating a sub-feedback control routine that is executed in the first embodiment of the present invention.

FIG. 3 is a flowchart for explaining the flow of the sub-feedback control implemented by the ECU in the present embodiment. The routine shown in FIG. 3 is executed in required timing with each fuel injection operation, and a judgment is made as to whether conditions for executing the sub-feedback control are established in a first step (step 100). The execution conditions here mean that the $O_2$ sensor 8 must be active and that a cooling water temperature must have risen to a required temperature. If the judgment indicates that the conditions for executing the sub-feedback control are established, the output signal from the $O_2$ sensor 8 is acquired in step 102.

In step 104, the sub-FB correction value is calculated from the output signal of the $O_2$ sensor 8, according to expressions (1) and (2) shown below. Expression (1) is associated with the process conducted by the comparator 12 in the controller of FIG. 1, and expression (2) is associated with the process conducted by the sub-FB controller 30.

$$doxs(k)=oxsref(k)-gaoxs(k) \tag{1}$$

$$sfb(k)=Gp_{sfb}*doxs(k)+Gd_{sfb}*\{doxs(k)-doxs(k-1)\} \tag{2}$$

In above expression (1), "gaoxs" denotes a value of the output signal from the $O_2$ sensor 8 and "oxsref" denotes an SFB target value. Therefore, "doxs" denotes an output deviation of the output signal from the $O_2$ sensor 8. In above expression (2), "sfb" denotes a sub-FB correction value, "$Gp_{sfb}$" denotes a proportional gain of the PD control conducted by the sub-FB controller 30, and "$Gd_{sfb}$" denotes a derivative gain of the PD control. The symbol "k" in each term means that the term is the current value (the value calculated in the current cycle), and "k−1" means the previous value (the value calculated in the previous cycle).

In step 106, the integral value for learning is calculated, according to expressions (3) and (4) shown below. Expressions (3) and (4) are associated with the respective processes conducted by the integrator 34 of the sub-FB learning unit 32 in the controller of FIG. 1.

$$sumdoxs=doxs(k)+sfbi(k-1) \tag{3}$$

$$sfbi(k)=Gi_{sfb}*sumdoxs(k-1) \tag{4}$$

In above expressions (3) and (4), "sumdoxs" denotes an integral value of the output deviation "doxs", and "sfbi" denotes the integral value obtained by multiplying "sumdoxs" by the gain "$Gi_{sfb}$". In this case, "sfbi" is output from the integrator 34 as an integral-term signal, and "Gisfb" is an integral gain of the I-control conducted by the integrator 34 of the sub-FB learning unit 32.

In step 108, a low-pass filtering process for the integral-term signal is performed according to expression (5) shown below. Expression (5) is associated with the process conducted by the low-pass filter 36 of the sub-FB learning unit 32 in the controller of FIG. 1.

$$sfbism(k)=\{sfbi(k-1)-(1-\tau_{sfbg})*sfbism(k-1)\}/\tau_{sfbg} \tag{5}$$

In above expression (5), "sfbism" denotes the integral-term signal obtained after the low-pass filtering process, and "$\tau_{sfbg}$" denotes the sampling rate (response time constant) used in the low-pass filtering process.

In step 110, it is judged whether the condition for acquiring into the learning value the integral-term signal that underwent the low-pass filtering process in step 108, i.e., an execution condition relating to learning, is established. This condition means that the total injection count from the previous learning operation must have reached a required count value. If the judgment indicates that the execution condition relating to learning is established, the integral-term signal that has underwent the low-pass filtering process in step 108 is written into the SRAM 38 and the learning value is derived and updated (step 112).

On execution of integral-term signal writing into the SRAM 38, state quantities of both the integrator 34 and the low-pass filter 36 are corrected (cleared). First, the state quantity of the low-pass filter 36 is corrected in accordance with the following expressions (6) and (7):

$$sfbi(k-1)=0 \tag{6}$$

$$sfbism(k-1)=0 \tag{7}$$

That is to say, values of all elements concerned with the low-pass filtering process in expression (5) are each reset to zero.

The state quantity of the integrator 34 is corrected in accordance with the following expression (8):

$$sumdoxs=sumdoxs-sfbism(k)/Gi_{sfb} \tag{8}$$

That is to say, the integral value in expression (3) is corrected to match the magnitude of the integral-term signal which was acquired into the SRAM 38. The "sumdoxs" term on the right side of expression (8) denotes the integral value before it is corrected, and "sumdoxs" on the left side denotes the integral value after it has been corrected.

When the above control is executed, the air-fuel ratio signal 100 from the A/F sensor 6 is corrected according to the particular sub-FB correction value and learning value, in a direction of offsetting a bias of an actual air-fuel ratio to the lean side or the rich side. Thus, operation in the neighborhood of a target air-fuel ratio becomes possible. In the controller of the present embodiment, in particular, as described above, I-control is conducted on the basis of the output deviation between the output signal from the $O_2$ sensor 8 and the SFB target value, and the learning value is derived only from the integral term obtained by the I-control. For these reasons, unlike the conventional controller, the controller of the present embodiment does not suffer the instability of learning due to the effects of variable components.

Figure 4A:
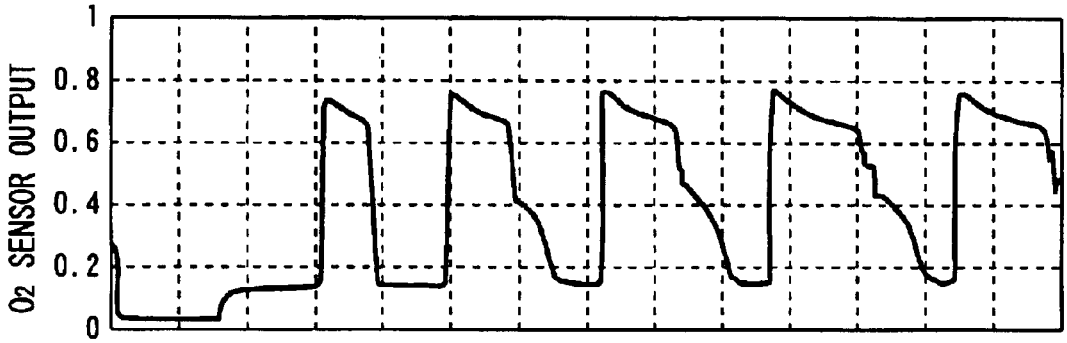
FIG. 4A shows a graph of time-varying changes in the output signal of the $O_2$ sensor.
Figure 4B:
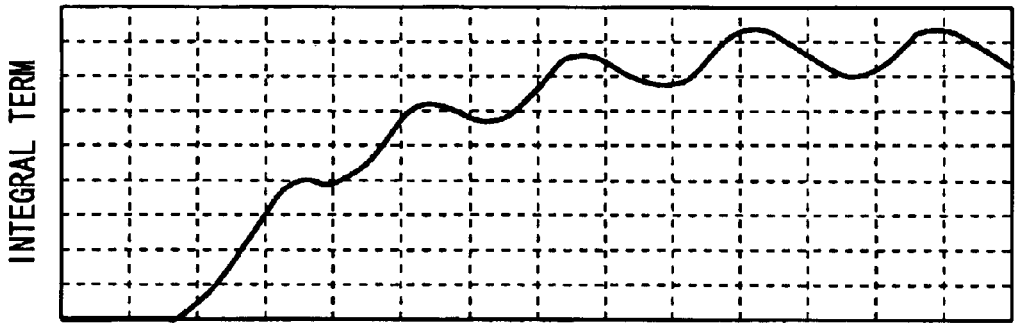
FIG. 4B shows a graph of time-varying changes in the integral value obtained when I-control is conducted based on such output signal states as shown in FIG. 4A.

FIG. 4A shows a graph of time-varying changes in the output signal of the $O_2$ sensor 8, and FIG. 4B shows a graph of time-varying changes in the integral value obtained when I-control is conducted based on such output signal states as shown in FIG. 4A. As shown in FIG. 4A, during the operation of the internal-combustion engine 2, the output signal from the $O_2$ sensor 8 is constantly changing between a lean-state output and a rich-state output. Accordingly, as shown in FIG. 4B, the integral term obtained by I-control causes secondary vibration coupled with the changes in the output signal of the $O_2$ sensor 8. Although an amplitude of the secondary vibration caused by the integral term is small in comparison with that of the vibration caused by derivative or proportional terms, the appropriate error in the learning value according to the particular amplitude of the secondary vibration occurs, depending on the timing of learning (the timing of writing into the SRAM 38).

A general method of reducing the vibration components included in the integral term is by reducing the control gain of I-control. However, reduction in the control gain correspondingly delays response, hence reducing the learning rate. Regarding this, the air-fuel ratio controller of the present embodiment uses the low-pass filter 36 to cut off the high-frequency components included in the integral term. Use of the low-pass filter 36 allows a learning value to be derived from a smooth integral-term signal free from high-frequency components, without reducing the learning rate. In short, according to the air-fuel ratio controller of the present embodiment, a learning value is derived from the integral term (integral value) indicating the steady-state deviation of the output signal of the $O_2$ sensor 8 and this integral term is smoothed; therefore, these characteristics not only keep the learning value free from any effects of such variable components as a proportional term and a derivative term, but also suppress secondary vibration due to the effects of the changes in the output signal of the $O_2$ sensor 8. A stable learning value can be obtained as a result.

While, in the present embodiment, the sub-FB controller 30 conducts PD control, this controller may be adapted to conduct P-control. Additionally, while, in the present embodiment, the air-fuel ratio signal 100 from the A/F sensor 6 is corrected using a sub-FB correction value and a learning value, the target air-fuel ratio obtained by the main feedback control may be corrected using a sub-FB correction value and a learning value. Furthermore, although, in the present embodiment, the integral-term signal 124 is input to not only the low-pass filter 36 but also the adder 14 concurrently, this signal may be input only to the low-pass filter 36. Besides, although an A/F sensor is used as the upstream-side exhaust gas sensor in the present embodiment, an $O_2$ sensor may be used similarly to the downstream-side exhaust gas sensor.

Second Embodiment

A second embodiment of the present invention is described below referring to FIG. 5.

Multiple parameters are used to calculate a learning value in sub-feedback control of an air-fuel ratio controller. In the air-fuel ratio controller of the present invention, as described for the first embodiment, multiple parameters, "sfbi", "sumdoxs", and "sfbism", are also used to calculate a learning value. In conventional devices, values of these parameters concerned with the calculation of a learning value are constantly updated as long as sub-feedback control is being executed under established sub-feedback control execution conditions. If the sub-feedback control execution conditions are not established, however, the above values are cleared and are newly calculated from the beginning when the sub-feedback control execution conditions are established next time. However, the fact that the parameters are cleared each time the sub-feedback control execution conditions fail to be established means that when sub-feedback control is restarted, it takes a great deal of time to converge the learning value and thus the learning rate decreases.

Figure 5:
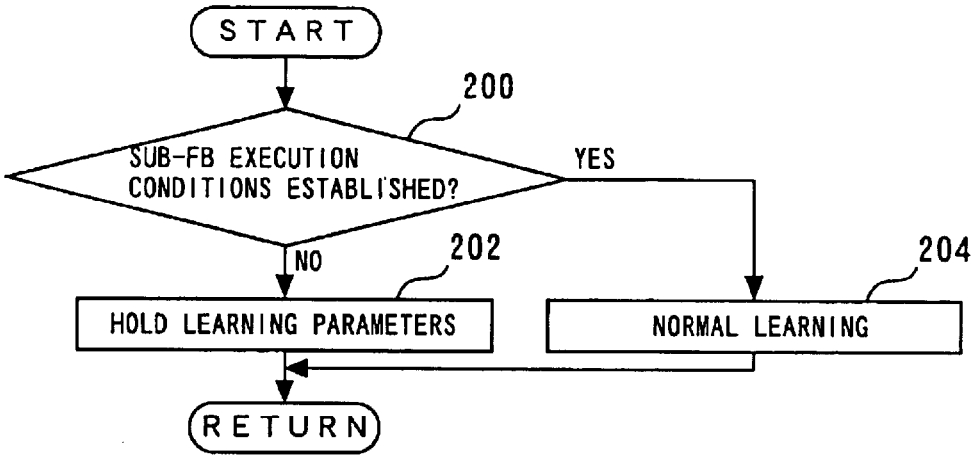
FIG. 5 is a flowchart illustrating a learning routine that is executed in a second embodiment of the present invention.

The air-fuel ratio controller according to the present embodiment, therefore, prevents a decrease in the learning rate during the restart of sub-feedback control, by making the ECU in the first embodiment further execute the routine shown in FIG. 5. This routine is executed in required timing with each fuel injection operation, and whether the execution conditions relating to sub-feedback control are established is judged in a first step (step 200).

If it is judged in step 200 that the sub-feedback control execution conditions are not established, the values of the parameters concerned with the calculation of the learning value are held. In other words, in step 202, the values of the parameters are not cleared and they are maintained at the respective values existing before the sub-feedback control execution conditions were judged not to be established, i.e., the values existing in the previous cycle.

When the sub-feedback control execution conditions are established, sub-feedback control is restarted and acquisition of the learning value is also restarted. When learning is restarted, the parameter values that were held in step 202 are used as initial values in step 204. This method, compared with calculating each parameter value from the beginning, makes it possible to shorten the time required for convergence of the learning value, and to maintain the learning rate even after sub-feedback control has been restarted.

In the above-described embodiment, the "execution conditions judging means" of the present invention is realized by execution of the process in step 200 by the ECU. Also, the "parameter data hold means" of the present invention is realized by execution of the process in step 202 by the ECU.

Third Embodiment

A third embodiment of the present invention is described below referring to FIG. 6.

In internal-combustion engines, the fuel cutoff for temporarily stopping fuel injection is conducted if the vehicle speed exceeds a maximum speed limit, if the engine speed reaches a speed limit, or under other required operating conditions. When the fuel cutoff is executed, since unburnt fresh air directly flows into a catalyst 4, an oxygen-occluding state of the catalyst 4 saturates in due course of time and an $O_2$ sensor continues to generate a lean-state output signal for a while after the fuel cutoff. If learning of the learning value in sub-feedback control is conducted under these conditions, the learning value is mis-learnt so that an air-fuel ratio signal 100 from an A/F sensor 6 is corrected to indicate a lean state.

Figure 6:
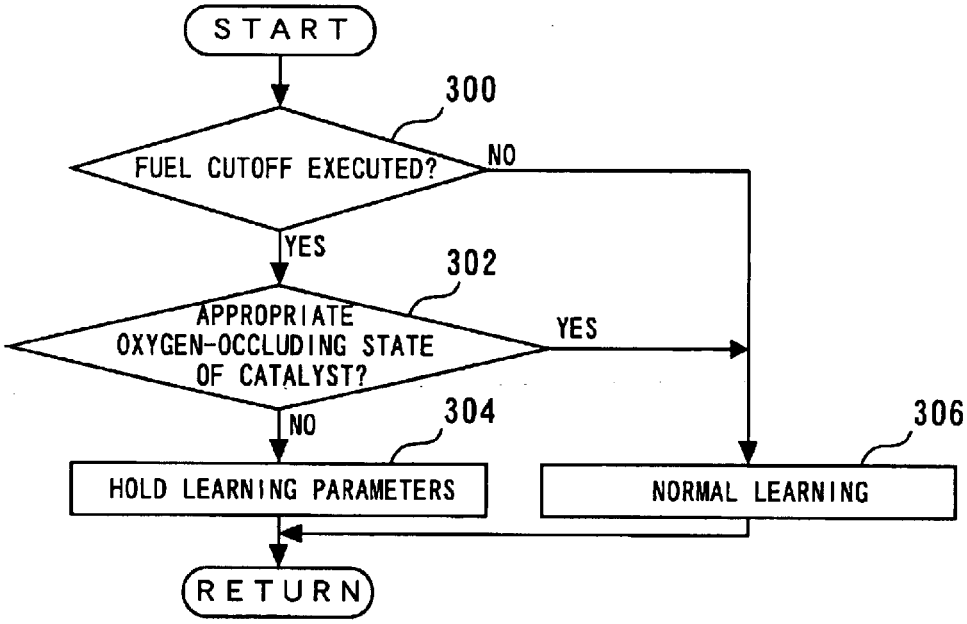
FIG. 6 is a flowchart illustrating a learning routine that is executed in a third embodiment of the present invention.

The air-fuel ratio controller according to the present embodiment, therefore, prevents mis-learning of the learning value during fuel cutoff, by making the ECU in the first embodiment further execute the routine shown in FIG. 6. This routine is executed in required timing with each fuel injection operation, and whether the fuel cutoff has been executed is judged in a first step (step 300).

After the fuel cutoff has been executed, it is next judged in step 302 whether an appropriate oxygen-occluding state of the catalyst 4 has been obtained. As one method of judging the oxygen-occluding state of the catalyst 4, it is possible to judge that when the output signal from the $O_2$ sensor 8 reverses to indicate a rich state, an appropriate oxygen-occluding state of the catalyst 4 has been obtained. Alternatively, it may be possible to judge that when the rate of an estimated amount of oxygen desorption after fuel cutoff, with respect to a maximum amount of oxygen occlusion by the catalyst 4, reaches a required value, an appropriate oxygen-occluding state of the catalyst 4 has been obtained.

In the air-fuel ratio controller of the present embodiment, after fuel cutoff, parameter values concerned with the calculation of the learning value are held until the appropriate oxygen-occluding state of the catalyst 4 has been obtained, i.e., until the condition required for the judgment in step 302 has been satisfied. In other words, the parameter values existing before fuel cutoff was executed are maintained intact without being updated, in step 304.

The update process for the learning value is restarted when the condition required for the judgment in step 302 is satisfied. In step 306, the parameter values that were held in step 304 are used as initial parameter values during the restart of the update process for the learning value. Use of this method makes it possible to learn using parameters not affected by fuel cutoff, and hence to prevent the learning value from being mis-learnt by a bias of the air-fuel ratio to the lean side.

In the above-described embodiment, the "fuel cutoff judging means" of the present invention is realized by execution of the process in step 300 by the ECU. Also, the "oxygen-occluding state judging means" of the present invention is realized by execution of the process in step 302 by the ECU. Furthermore, the "parameter data hold means" of the present invention is realized by execution of the process in step 304 by the ECU.

The major benefits of the present invention described above are summarized follows:

According to a first aspect of the present invention, since a learning value is derived from the integral value indicating a steady-state deviation of the output signal sent from the downstream exhaust gas sensor, the learning value is not affected by variable components such as a proportional value or derivative value. Additionally, since the integral value is smoothed, secondary vibration due to any effect of a change in the output signal of the downstream exhaust gas sensor is also suppressed and a stable learning value can be obtained.

According to a second aspect of the present invention, even if a feedback condition is not established, since parameter values related to calculation of the learning value will not be cleared and the parameter values existing before the feedback condition is not established will be maintained, the learning rate can be maintained, even after the restart of feedback.

According to a third aspect of the present invention, although a fuel cut saturates the oxygen-occluding state of the catalyst and, if learning is conducted in that saturated state, the learning value will be mis-learned for a bias toward the rich side, mis-learning of the learning value can be prevented since, until the oxygen-occluding state has stayed within an appropriate range, parameter values related to calculation of the learning value will be maintained at the values existing before the feedback conditions are not established.

What is claimed is:

1. An air-fuel ratio controller for an internal-combustion engine, comprising:

an upstream-side exhaust gas sensor disposed upstream of a catalyst in an exhaust passageway of the internal-combustion engine;

a downstream-side exhaust gas sensor disposed downstream of the catalyst;

main feedback means for feeding back an output signal received from said upstream-side exhaust gas sensor into a fuel injection rate so that an air-fuel ratio of the exhaust gases flowing into the catalyst may match a target air-fuel ratio; and sub-feedback means for feeding back the output signal received from said downstream-side exhaust gas sensor into the fuel injection rate so as to complement the feedback control conducted by said main feedback means;

wherein said sub-feedback means includes:

integral-data calculation means for calculating an integral value of a deviation between a value of the output signal of said downstream-side exhaust gas sensor and a reference value;

smoothing means for smoothing the integral-data signal received from said integral-data calculation means; and learning means for learning, from the integral-data signal smoothed, a learning value which compensates for a permanent error included in the output signal of said upstream-side exhaust gas sensor.

2. The air-fuel ratio controller for an internal-combustion engine according to claim 1, wherein said sub-feedback means further includes a correction value calculation means for calculating, as a feedback correction value, a proportional value and a derivative value of a deviation between a value of the output signal of said downstream-side exhaust gas sensor and a reference value, and feeds back the learning value and the feedback correction value into the fuel injection rate control conducted by said main feedback means.

3. The air-fuel ratio controller for an internal-combustion engine according to claim 1, wherein said sub-feedback means further includes a correction value calculation means for calculating, as a feedback correction value, a proportional value of a deviation between a value of the output signal of said downstream-side exhaust gas sensor and a reference value, and feeds back the learning value and the feedback correction value into the fuel injection rate control conducted by said main feedback means.

4. The air-fuel ratio controller for an internal-combustion engine according to claim 1, wherein said sub-feedback means corrects the output signal from said upstream-side exhaust gas sensor using the learning value.

5. The air-fuel ratio controller for an internal-combustion engine according to claim 1, wherein said sub-feedback means corrects the target air-fuel ratio using the learning value.

6. The air-fuel ratio controller for an internal-combustion engine according to claim 1, wherein said smoothing means is a low-pass filter.

7. The air-fuel ratio controller for an internal-combustion engine according to claim 1, wherein said sub-feedback means further includes:

execution condition judging means for judging whether a condition required for feedback of the output signal of said downstream-side exhaust gas sensor into the fuel injection rate is established; and parameter data hold means which, if the feedback condition is judged not to be established, holds, as parameter data related to calculation of the learning value, the data existing before the feedback condition was judged not to be established, until the feedback condition has been judged next time to be established.

8. The air-fuel ratio controller for an internal-combustion engine according to claim 1, wherein said sub-feedback means further includes:

fuel cutoff judging means for judging whether fuel cutoff is in progress;

oxygen-occluding state judging means for judging whether an oxygen-occluding state of the catalyst is within an appropriate range; and parameter data hold means which, after execution of the fuel cutoff, holds, as parameter data related to calculation of the learning value, the data existing before the execution of the fuel cutoff, until the oxygen-occluding state of the catalyst has fallen within the appropriate range.

* * * * *